United States Patent [19]

Blanton, Jr.

[11] 4,309,309

[45] Jan. 5, 1982

[54] ADDING FUEL IN CATALYST REGENERATION

[75] Inventor: William A. Blanton, Jr., Woodacre, Calif.

[73] Assignee: Chevron Research Company, San Francisco, Calif.

[21] Appl. No.: 163,536

[22] Filed: Jun. 27, 1980

[51] Int. Cl.[3] ..... B01J 21/20; B01J 29/38; C10G 11/18

[52] U.S. Cl. ..... 252/417; 208/113; 208/120; 208/164; 252/419

[58] Field of Search ..... 252/417, 419; 208/113, 208/120, 164

[56] References Cited

U.S. PATENT DOCUMENTS

| | | | |
|---|---|---|---|
| 2,414,883 | 1/1947 | Martin | 252/417 |
| 3,857,794 | 12/1974 | Carey | 252/419 |
| 3,909,392 | 9/1975 | Horecky, Jr. et al. | 208/120 |
| 4,051,069 | 9/1977 | Bunn, Jr. et al. | 208/120 |
| 4,056,486 | 11/1977 | Bunn, Jr. et al. | 252/417 |
| 4,072,600 | 2/1978 | Schwartz | 208/120 |
| 4,152,292 | 5/1979 | Conner et al. | 252/417 |
| 4,180,454 | 12/1979 | Luckenbach | 208/113 |
| 4,199,435 | 4/1980 | Chessmore et al. | 208/113 |

FOREIGN PATENT DOCUMENTS

| | | | |
|---|---|---|---|
| 2001545 | 2/1979 | United Kingdom | 252/419 |

*Primary Examiner*—P. E. Konopka

*Attorney, Agent, or Firm*—D. A. Newell; S. R. LePaglia; J. W. Ambrosius

[57] ABSTRACT

A process for removing coke from particulate catalyst is disclosed, in which nitrogen oxides are formed during combustion of nitrogen-containing coke in an oxidizing atmosphere in the presence of a carbon monoxide combustion promoter in a lower portion of a fluidized bed, and the nitrogen oxides are reacted to form free nitrogen by introducing a vaporizable fuel into an upper part of the fluidized bed.

5 Claims, 1 Drawing Figure

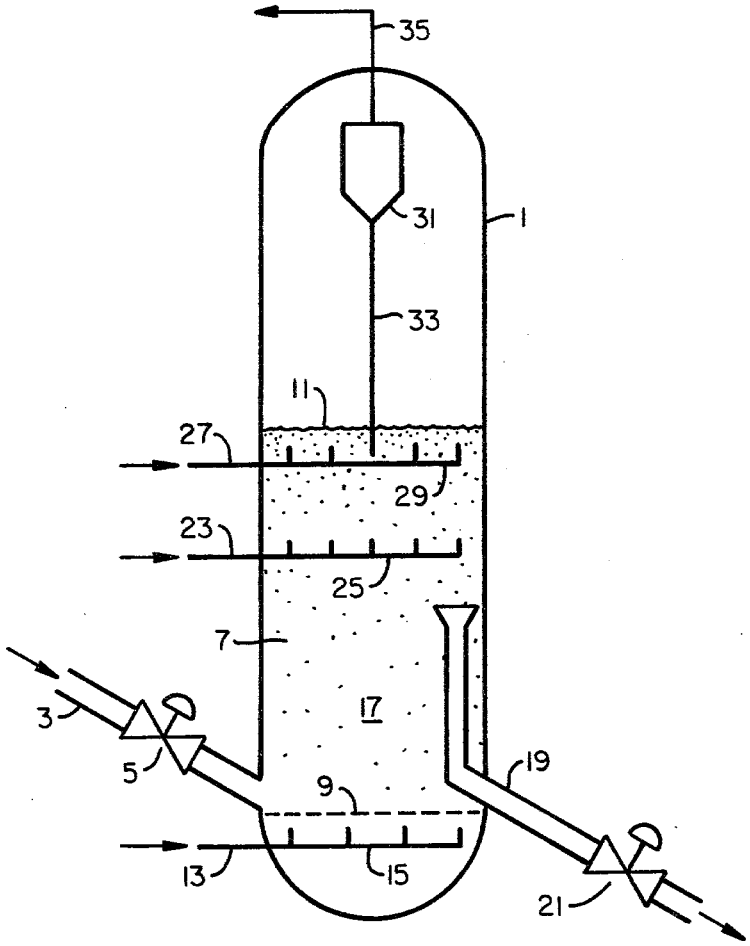
35
31
1
33
11
27
29
23
25
7
17
3
5
19
9
13
15
21

ADDING FUEL IN CATALYST REGENERATION

BACKGROUND OF THE INVENTION

This invention concerns the art of catalyst regeneration. More specifically, the present invention concerns a method for regenerating coke-contaminated particulate catalyst and avoiding nitrogen oxides contamination of flue gas formed by coke combustion.

Catalytic cracking systems employ catalyst in a moving bed or a fluidized bed. Catalytic cracking is carried out in the absence of externally supplied molecular hydrogen, and is, for that reason, distinctly different from hydrocracking, in which molecular hydrogen is added during the cracking operation. In catalytic cracking, an inventory of particulate catalyst is continuously cycled between a cracking reactor and a catalyst regenerator. In a fluidized catalytic cracking (FCC) system, hydrocarbon feed is contacted with catalyst particles in a hydrocarbon cracking zone, or reactor, at a temperature of about 425° C.–600° C., usually 460° C.–560° C. The reactions of hydrocarbons at the elevated operating temperature result in deposition of carbonaceous coke on the catalyst particles. The resulting fluid products are separated from the coke-deactivated, spent catalyst and are withdrawn from the reactor. The coked catalyst particles are stripped of volatiles, usually by means of steam, and passed to the catalyst regeneration zone. In the catalyst regenerator, the spent catalyst is contacted with a predetermined amount of molecular oxygen. A desired portion of the coke is burned off the catalyst, restoring catalyst activity and simultaneously heating the catalyst to, e.g., 540° C.–815° C., usually 590° C.–730° C. Flue gas formed by combustion of coke in the catalyst regenerator may be treated for removal of particulates and for conversion of carbon monoxide, after which the flue gas is normally discharged into the atmosphere.

Most fluidized catalytic cracking systems now use zeolite-containing catalyst having high activity and selectivity. Zeolite-type catalyst have a particularly high activity when the concentration of coke on the catalyst after regeneration is relatively low. It is therefore desirable to regenerate zeolite-containing catalysts to as low a residual carbon level as is possible, so as to obtain a relatively high activity and selectivity. It is also desirable to burn carbon monoxide as completely as possible during catalyst regeneration to obtain additional heat, especially when the concentration of coke on the spent catalyst is already quite low as a result of high catalyst selectivity. Among the ways suggested to help reduce the amount of coke on regenerated catalyst and to burn carbon monoxide to provide process heat, is enhanced carbon monoxide combustion in a dense-phase fluidized catalyst bed in the catalyst regenerator promoted by an active, combustion promoting metal. Metals have been used either as an integral component of the cracking catalyst particles or as a component of a separate particulate additive, in which the active metal is associated with a support other than the catalyst particles. Additive particles are mixed with catalyst particles in the circulating particulate solids inventory. Various ways of employing carbon monoxide combustion promoting metals in cracking systems have been suggested. In U.S. Pat. No. 2,647,860, it is proposed to add 0.1-1 weight percent chromic oxide to a cracking catalyst to promote combustion of carbon monoxide to carbon dioxide and to prevent after burning. In U.S. Pat. No. 3,808,121, it is proposed to introduce relatively large sized particles containing a carbon monoxide combustion promoting metal into a cracking catalyst regenerator. The circulating particulate solids inventory, comprised of relatively small-sized catalyst particles, is cycled between the cracking reactor and the catalyst regenerator, while the combustion promoting particles remain in the regenerator because of their size. Oxidation promoting metals such as cobalt, copper, nickel, manganese, copper-chromite, etc., impregnated on an inorganic oxide such as alumina, are disclosed. Belgium Patent Application No. 820,181 suggests using catalyst particles containing platinum, palladium, iridium, rhodium, osmium, ruthenium or rhenium to promote carbon monoxide oxidation in a catalyst regenerator. An amount of the metal between a trace and 100 parts per million is added to the catalyst particle, either during catalyst manufacture or during the cracking operation, as by addition of a compound of the combustion promoting metal to the hydrocarbon feed. Addition of the promoting metal to the cracking system is said by the publication to decrease product selectivity in the cracking step by substantially increasing coke and hydrogen formation. Catalyst particles containing the promoter metal can be used alone or can be circulated in physical mixture with catalyst particles free of the combustion promoting metal. U.S. Pat. Nos. 4,072,600 and 4,093,535 disclose the use of combustion promoting metals in cracking catalysts in concentrations of 0.01 to 50 ppm, based on total catalyst inventory.

One problem encountered in some cracking operations using metal promoted combustion-type regeneration to provide substantially coke-free regenerated catalyst has been the generation of undesirable nitrogen oxides ($NO_x$) in the flue gas formed during coke combustion. The present invention is directed, in part, toward providing a catalyst regeneration system, which accomplishes substantially complete removal of coke during catalyst regeneration, while substantially lowering the concentration of nitrogen oxide present in flue gas produced by the regeneration operation.

Representative of catalyst regeneration patent literature previously published are the following patents: U.S. Pat. No. 3,909,392 describes a scheme for enhancing carbon monoxide combustion by thermal means. Catalyst is used a heat sink for the increased heat production. U.S. Pat. No. 4,093,535 describes a scheme for enhancing carbon monoxide combustion by means of a noble metal combustion promoter. British patent publication No. 2,001,545 describes a two-stage system for regenerating catalyst, with partial catalyst regeneration being carried out in the first stage and secondary, more complete regeneration carried out in the second stage with a separate regeneration gas. U.S. Pat. No. 3,767,566 describes a two-stage regeneration scheme in which partial regeneration takes place in an entrained catalyst bed, and secondary, more complete regeneration takes place in a dense fluidized catalyst bed. A somewhat similar regeneration operation is described in U.S. Pat. No. 3,902,990, which discusses the use of several stages of regeneration, with dilute and dense-phase beds of catalysts being employed, and with the use of plural streams of regeneration gas. U.S. Pat. No. 3,926,843 describes a plural-stage regeneration scheme in which dilute phase and dense-phase coke burning are performed. British patent publication No. 1,499,682 discloses use of a combustion-promoting metal for enhancing carbon monoxide combustion. None of the above cited patents provides a method for forming a flue gas having low concentrations of both carbon monoxide and nitrogen oxides, while accomplishing essentially complete removal of coke from the catalyst.

Addition of a fuel such as "torch oil" to a cracking catalyst regenerator has been practiced commercially for the purpose of maintaining a cracking system in heat balance.

SUMMARY OF THE INVENTION

I have found that nitrogen-containing coke can be removed from a particulate catalyst by burning off sufficient coke to provide an essentially carbon-free catalyst, and a flue gas substantially free from both carbon monoxide and $NO_x$ can be formed in carrying out the regeneration by (a) passing a regeneration gas comprising free oxygen upwardly through a vertically extending fluidized bed of substantially coke-free particulate catalyst, and introducing coke-containing catalyst into the fluidized bed; (b) burning nitrogen-containing coke off the coke-containing catalyst present in a lower portion of the fluidized bed and burning substantially all carbon monoxide generated in the lower portion of the bed in the presence of a combustion-promoting metal, sufficient fee oxygen being introduced into the bed in the regeneration gas to provide at least 1 volume percent residual-free oxygen in the regeneration gas when the regeneration gas passes above the lower portion of the bed, whereby coke is removed from the coke-containing catalyst and nitrogen oxide are formed in the lower portion of the bed; (c) generating a reducing atmosphere including at least 0.05 volume percent carbon monoxide and less than 0.5 volume percent free oxygen in the regeneration gas above the lower portion of the fluidized bed by reacting the residual free oxygen with a combustible hydrocarbonaceous fuel introduced into the regeneration gas above the lower portion of the bed and decreasing the amount of nitrogen oxides in the regeneration as by reacting at least a portion of the nitrogen oxides in the reducing atmosphere to form free nitrogen.

DESCRIPTION OF THE DRAWING

The attached drawing is a schematic representation of one preferred embodiment of the present invention.

Referring to the drawing, there is shown a regeneration vessel 1. Deactivated, coke-containing catalyst is introduced into the vessel 1 through a conduit 3 at a rate controlled by a valve 5. A dense-phase fluidized bed 7 of substantially coke-free catalyst is maintained in the vessel 1 above a gas distribution grid 9. The top of the dense-phase fluidized bed is indicated by a line at 11. Regeneration gas containing free oxygen is introduced into the lower end of the vessel through a conduit 13 and a distributor 15. The regeneration gas passes upwardly through the grid 9 and the fluidized bed 7. Substantially all the coke in the spent and partially regenerated catalyst present in a lower portion 17 of the fluidized bed is burned with free oxygen in the regeneration gas. Substantially coke-free catalyst is withdrawn from the fluidized bed through a conduit 19 at a rate controlled by a valve 21. A combustible hydrocarbonaceous fuel is introduced into the regenerator through a conduit 23 and is introduced into the regeneration gas in contact with the part of the bed 7 above the lower portion 17 by means of a distributor 25. Additional free oxygen is introduced into the top portion of the dense-phase fluidized bed 7 through a conduit 27 and is mixed with the regeneration gas near the top 11 of the bed by means of a distributor 29. Regeneration gas (flue gas) passes above the top 11 of the bed 7 and into a cyclone separator 31. Entrained catalyst particles are separated from the flue gas in the cyclone and are returned to the dense-phase catalyst bed through a dipleg 33. The flue gas is then withdrawn from the vessel 1 through a conduit 35. Conventional elements of the embodiment depicted, such as controlling means, pumping and valve means, and the like, are not shown in the drawing and are not described in order to simplify the explanation. The use and disposition of such elements will be clear to those skilled in the art.

DETAILED DESCRIPTION OF THE INVENTION

As used herein, the term "oxidizing atmosphere" means an atmosphere containing more than 0.5 volume percent molecular oxygen acid and less than 0.05 volume percent carbon monoxide.

As used herein, the term "reducing atmosphere" means an atmosphere containing at least 0.05 volume percent carbon monoxide and less than 0.5 volume percent molecular oxygen.

As used herein, the term "substantially coke-free catalyst" refers to catalyst which contains less than 0.2 weight percent carbon.

As used herein, the term "dense-phase fluidized bed" means a fluidized bed of particulate solids having a density of at least 12 pounds per cubic foot.

Catalysts that are best adapted for coke removal according to this invention are those in the form of particulate solids. Preferably, catalyst to be treated is sized appropriately for catalytic use in an entrained bed or fluidized bed operation. With reference to the types of catalytic hydrocarbon conversion operations presently practiced commercially, this invention is especially advantageous for regeneration of FCC catalysts; however, use of the invention is not limited to FCC catalyst regeneration, and can be used for treating any coke-contaminated particulate catalyst which can be improved by coke burnoff.

Coke removal according to the invention can be carried out in a suitable vessel or chamber, capable of containing the regeneration gas and catalyst particles at the temperature and pressure employed. Suitable vessels will be readily apparent to those skilled in the art from the description herein. Conventional FCC cracking catalyst regeneration systems, for example, can suitably be employed, with modifications which will be apparent from the present description.

The regeneration gas or gas mixture employed must have an appropriate free oxygen (molecular oxygen) content. Normally, air is quite suitable for use in supplying free oxygen, but use of air is not essential. For example, pure oxygen or oxygen-enriched air can also be used, if desired. Conventional gases used in commercial FCC operations, such as free nitrogen (molecular nitrogen), carbon dioxide, steam, and the like, are suitable for use as fluidizing and entrainment gases.

In general, regeneration conditions employed include a combination of temperature and pressure sufficient to permit the specified degree of coke combustion, carbon monoxide combustion and nitrogen oxides reduction to take place, in the manner discussed herein. Temperatures of 540° C. to 815° C. are normally quite suitable. Temperatures of 590° C. to 730° C. are preferred. The rates of flow of regeneration gases, entrainment gases and catalyst particles through the system are maintained at levels which provide a dense-phase fluidized bed of catalyst. Fluid bed operation can be accomplished in a conventional manner by maintaining upward superficial gas velocities appropriate to the size and density of catalyst particles undergoing regeneration and by maintaining catalyst introduction and withdrawal rates at proper levels. The operating pressure is usually not particularly critical. Pressures of 1–20 atmospheres are generally quite suitable. Pressures of 2–5 atmospheres are preferred.

Because rapid, complete combustion of coke and carbon monoxide in the dense-phase bed is necessary in carrying out the invention, it is essential to employ a carbon monoxide combustion-promoting metal to aid in burning carbon monoxide in the regeneration gas within the lower portion of the dense-phase bed. Metals previously suggested for use as carbon monoxide combustion promoters, e.g. many of the transition metals, can be used. Mixtures of metals are also suitable. Preferred metals for use in promoting carbon monoxide combustion in carrying out the invention include platinum, palladium, iridium, rhodium, ruthenium, osmium, manganese, copper and chromium. The combustion-promoting metal is employed in an amount sufficient to enhance the rate of carbon monoxide burning, preferably in an amount sufficient to provide substantially complete combustion of carbon monoxide in the lower portion of the catalyst bed. In commercial FCC catalyst regeneration systems, the use of platinum in various forms as a combustion-promoting metal is well known. A combustion-promoting metal may be included as a component of all, or a major or minor fraction, of the catalyst particles or may be included as a component of discreet, substantially catalytically inert particles which are mixed with the catalyst particles and circulated as a physical mixture with the catalyst particles. A preferred metal for use in separate combustion-promoting particles is platinum. Generally, a platinum promoter is preferably included in the regenerator in an amount sufficient to provide complete carbon monoxide combustion in the lower part of the catalyst bed.

Sulfur oxides contamination of the flue gas formed in burning coke off the catalyst, when the coke contains a sulfur component, may advantageously be at least partially avoided by using a solid reactant, or acceptor, as a component of the particulate solids subjected to regeneration. Sulfur oxides in the flue gas react with, or absorb on, the reactant or acceptor to form sulfur-containing solids in the regenerator. In this way, the sulfur oxides content of the flue gas leaving the regenerator may be at least partially lowered. A preferred solid reactant is alumina. Alumina reacts with sulfur oxides to form a sulfur-containing solid. The alumina used should have a surface area of at least 50 square meters per gram. Alumina may be included as a component of all or part of the catalyst particles or may be included in discreet, substantially catalytically inactive particles physically admixed with the catalyst particles. If separate alumina-containing particles are added to the catalyst, a sufficient amount of alumina is preferably mixed with the catalyst to provide a substantial reduction in the level of sulfur oxides in the flue gas formed during regeneration. Usually, good results can be achieved if 0.1 to 25 weight percent alumina is added. If alumina is used as a component of the catalyst particles themselves, the catalyst particles preferably are selected to include a substantial concentration of a substantially silica-free alumina phase.

It will be apparent to those skilled in the art that the amount of coke contained in spent, deactivated catalyst, as well as the concentration of nitrogen and sulfur impurities in the coke, will vary widely depending on such factors as the composition and boiling range of the hydrocarbon feed being converted using the catalyst, the composition of the catalyst, the type of reaction system in which the catalyst is used (e.g., moving bed, fluid bed, entrained bed), etc. The benefits of regeneration according to the invention can be obtained with coke-containing catalysts which have a coke concentration varying over a broad range and for catalysts contaminated with coke having a nitrogen content which can vary over a broad range.

According to the invention, a vertically extending fluidized bed of substantially coke-free particulate catalyst if maintained in an appropriate vessel, chamber, or the like. The average carbon content of the catalyst particles in the bed as a whole is less than 0.2 weight percent. Preferably, the average concentration of coke carbon present in the catalyst particles in the bed as a whole is less than 0.1 weight percent. Coke-containing, deactivated catalyst is introduced into the dense-phase fluidized bed at a controlled rate. Regenerated, substantially coke-free catalyst is removed from the fluidized bed in order to maintain the bed at the desired size and density. Preferably, the deactivated catalyst particles are introduced into a relatively lower portion of the dense-phase fluidized bed, and the substantially coke-free catalyst particles are removed from a relatively higher portion of the bed. Because of the high turbulence and good overall mixing inherent in the fluidized bed system, however, catalyst present in any portion of the fluidized bed includes a minor proportion of partially regenerated catalyst particles mixed with a major proportion of substantially coke-free particles. Coke-containing catalyst is introduced into the bed at a rate low enough so that the average coke content of catalyst in the bed as a whole is not raised above 0.2 weight percent, and preferably not above 0.1 weight percent.

Regeneration and fluidizing gas comprising free oxygen is introduced into the lower end of the dense-phase fluidized bed. The regeneration gas is passed upwardly through the bed and is removed from the upper end of the bed. Enough free oxygen is introduced into the lower portion of the bed to provide an oxidizing atmosphere containing at least one volume percent free oxygen in all parts of the lower portion of the bed. Preferably, the regeneration gas is introduced with enough free oxygen to provide at least 3 volume percent free oxygen in all parts of the lower portion of the bed. The lower portion of the fluidized bed, i.e., the portion of the bed in which an oxidizing atmosphere is maintained containing at least one volume percent free oxygen, preferably constitutes about 40 weight percent to about 95 weight percent of the total volume of the dense-phase fluidized bed. Particularly preferably, the lower portion of the bed in which catalyst is in contact with the oxidizing atmosphere constitutes between 60 and 90 percent of the total volume of the dense-phase fluidized bed. By carrying out essentially complete coke and carbon monoxide combustion in the lower portion of the bed, it is possible to provide a regenerated catalyst which is essentially free from carbon. Thus, provision of an oxidizing atmosphere and use of a combustion promoter are highly desirable.

The oxidizing atmosphere provided in the lower portion of the fluidized bed and the essentially complete combustion of coke and carbon monoxide in the lower portion of the bed result in combustion of nitrogencontaining compounds in the coke on the partially regenerated catalyst contained in the lower portion of the bed in a manner which tends to generate nitrogen oxides. Generation of nitrogen oxides is particularly severe when combustion is carried out in the presence of carbon monoxide combustion promoting metals such as platinum. Accordingly, the regeneration gas is contaminated with nitrogen oxides when the gas passes upwardly out of the lower portion of the fluidized bed.

A reducing atmosphere is generated in the regeneration gas above the lower portion of the fluidized bed in order to remove nitrogen oxides from the regeneration gas. Removal of nitrogen oxides from the gas is accomplished, according to the invention, by removing residual free oxygen from the regeneration gas leaving the lower portion of the bed through combustion of a combustible hydrocarbonaceous fuel. Preferably, the hydrocarbonaceous fuel is a vaporizable hydrocarbon. Suitable vaporizable fuels may be one or more gaseous or liquid hydrocarbons, carbon monoxide, etc. When the combustible hydrocarbonaceous fuel is introduced, the fuel and residual free oxygen contained in the regeneration gas react very rapidly to provide an oxygen-free atmosphere. Addition of the combustible material to the regeneration gas has the effect of reducing the free oxygen concentration in the regeneration gas rapidly to less than 0.5 volume percent, preferably less than 0.1 volume percent. Because of combustion of the fuel in a part of the regeneration gas having a decreased free oxygen content (as a result of coke burning in the lower part of the bed) and also as a result of reactions between steam, coke and carbon dioxide, the reducing atmosphere generated in the regeneration gas by introducing the fuel includes at least 0.05 volume percent carbon monoxide, preferably at least 0.1 volume percent carbon monoxide.

The amount of combustible hydrocarbonaceous fuel introduced into the fluidized bed is at least sufficient to react with most of the residual free oxygen contained in the regeneration gas leaving the lower portion of the bed. The amount of fuel introduced is at least sufficient to decrease the free oxygen level to less than 0.5 volume percent. The fuel can conveniently be introduced into the regeneration gas stream by means of a conventional distributor. Preferably, the fuel is introduced relatively uniformly over essentially a complete horizontal crossection of the flow path of the regeneration gas through the fluidized bed. Uniform distribution of the fuel over a complete horizontal cross-section of the regeneration gas flow path has the advantage of insuring that essentially all the regeneration gas leaving the lower portion of the bed is exposed to the reducing atmosphere provided by combustion of the fuel. By introducing the fuel and generating a reducing atmosphere in the regeneration gas, nitrogen oxides contaminating the regeneration gas when it leaves the lower portion of the bed are reacted to form nonpolluting free nitrogen. This permits flue gas discharged from the catalyst regenerator to be removed from the regenerator with a much lower nitrogen oxides content than would otherwise be possible, when burning substantially all coke off the catalyst in the presence of a combustion-promoting metal.

Preferably, substantially all the carbon monoxide formed during generation of the reducing atmosphere in the fluidized bed by combustion of the combustible hydrocarbonaceous fuel is burned with added free oxygen downstream from the reducing atmosphere in the regeneration gas flow path while the regeneration gas is still in contact with the top portion of the dense-phase fluidized bed. Combustion of carbon monoxide from the reducing atmosphere is accomplished by introducing additional free oxygen into the regeneration gas in contact with the top part of the fluidized bed above the portion of the bed in contact with the reducing atmosphere. Combustion of the small quantity of carbon monoxide, hydrocarbons, etc., with the additional free oxygen results in the liberation of heat energy into the regeneration gas. By carrying out the combustion of the small amount of combustible material in regeneration gas having the reducing atmosphere section, in contact with catalyst particles in the top portion of the dense-phase bed, the heat energy evolved in rapidly absorbed by the catalyst particles. In this way, the temperature of the regeneration gas (flue gas) does not rise excessively as a result of the additional combustion. Essentially complete combustion of carbon monoxide in the regeneration gas, combined with reacting nitrogen oxide in the regeneration gas to form free nitrogen, permits a flue gas to be discharged from the regeneration operation with little or no nitrogen oxides and carbon monoxide content.

The additional combustion is preferably carried out in contact with less than 10%, particularly preferably less than 5% of the total volume of the dense-phase fluidized bed. This permits any further generation of nitrogen oxides as a result of coke burning to be minimized.

PREFERRED EMBODIMENT

The invention can best be further understood by referring to one of the particular preferred embodiments of the invention shown in the attached drawing.

In carrying out a preferred embodiment of the invention, spent zeolite type FCC catalyst preferably a type which includes a discreet alumina phase in the catalyst particles, is regenerated. A combustion promoting metal additive is employed in the system, preferably in the form of alumina particles containing 0.02–0.1 weight percent platinum. The additive particles are preferably mixed with the catalyst particles in an amount sufficient to provide about 0.1 to 10 parts per million (weight), e.g. one part per million, of platinum in the mixture of catalyst and combustion-promoting additive. The spent FCC catalyst to be regenerated typically contains about 0.4–1.0 weight percent coke, of which typically 0.1–1.0 weight percent is nitrogen. It will be apparent to those skilled in the art that the amount of coke contained in typical spent FCC catalyst, and the amount of nitrogen content in the coke vary substantially, depending on the specific feed, conversion conditions and catalyst employed. The mixture of coke-containing catalyst and combustion-promoting additive is introduced into the dense-phase fluidized bed of substantially coke-free catalyst in the regeneration vessel 1. Deactivated catalyst is introduced into the vessel at the rate of about 50 tons per minute. The dense-phase fluidized bed 7 of catalyst in the vessel has an overall average coke content of less than 0.1 weight percent. A regeneration gas such as air is introduced into the bottom of the bed 7 from the distributor 15 and upwardly through the grid 9. The regeneration gas initially contains sufficient free oxygen so that the gas reaching the level of the fuel distributor 25 has a residual free oxygen content of at least 1 volume percent, preferably at least 3 volume percent. In the regeneration gas in contact with the lower portion 17 of the bed 7 below the distributor 25, substantially all the carbon monoxide generated by combustion is burned to form carbon dioxide. Thus, the atmosphere of the regeneration gas in contact with the lower portion 17 of the bed may be characterized as a relatively highly oxidizing atmosphere. Sufficient vaporizable hydrocarbon fuel, e.g. one or more $C_1$–$C_4$ hydrocarbons, preferably boiler fuel gas, is introduced into the regeneration gas through the distributor 25 to react with essentially all the residual free oxygen present in the regeneration gas as the gas reaches the level of the fuel distributor 25. Combustion of fuel gas with residual oxygen in the regeneration gas stream in contact with the catalyst bed between the distributor 25 and the distributor 29 provides a reducing atmosphere in this part of the bed. Nitrogen oxides present in the regeneration gas are thereby reacted to form free nitrogen. Free oxygen is introduced into the regeneration gas through the distributor 29, and combustible components of the regeneration gas are substantially completely burned with this additional free oxygen before the regeneration gas rises above the top 11 of the dense-phase fluidized bed. Sufficient free oxygen is preferably added to the regeneration gas by way of the distributor 20 so that flue gas leaving the vessel 1 through the conduit 35 contains at least 1 volume percent free oxygen. Nitrogen oxides are formed in the lower portion 17 of the bed, wherein complete combustion of coke and carbon monoxide is carried out in a relatively highly oxidizing atmosphere. These nitrogen oxides are reacted in the reducing atmosphere present in the regeneration gas in contact with the bed between the level of the distributor 25 and the level of the distributor 29 to form free nitrogen. Since the residual carbon monoxide present in the regeneration gas is burned in the upper portion of the bed above the distributor 29, the flue gas leaving the regenerator through the conduit 35 includes little or no carbon monoxide and also little or no nitrogen oxides.

A preferred embodiment of the present invention having been described, alternatives and modifications of the embodiment depicted will be apparent to those skilled in the art. Such modifications and equivalents of the depicted embodiment are intended to be included within the scope of the invention as defined in the appended claims.

What is claimed is:

1. A method for removing nitrogen-containing coke from coke-containing particulate catalyst which comprises:

(a) passing a regeneration gas comprising free oxygen upwardly through a vertically extending fluidized bed of substantially coke-free particulate catalyst, and introducing said coke-containing catalyst into said fluidized bed;

(b) burning said nitrogen-containing coke off coke-containing catalyst present in a lower portion of said fluidized bed and burning substantially all carbon monoxide generated in said lower portion of said bed in the presence of a combustion-promoting metal, sufficient free oxygen being introduced into said bed in said regeneration gas to provide at least 1 volume percent residual-free oxygen in said regeneration gas in said lower portion of said bed, whereby coke is removed from said coke-containing catalyst and nitrogen oxide are formed in said lower portion of said bed;

(c) generating a reducing atmosphere including at least 0.05 volume percent carbon monoxide and less than 0.5 volume percent free oxygen in said regeneration gas above said lower portion of said fluidized bed by reacting said residual free oxygen with a combustible fuel introduced into said regeneration gas above said lower portion of said bed, thereby decreasing the amount of nitrogen oxides in said regeneration gas by reacting at least a portion of said nitrogen oxides in said reducing atmosphere to form free nitrogen;

(d) and burning the carbon monoxide present in said regeneration gas above the lower portion of said bed with additional free oxygen while in contact with said bed above said reducing zone.

2. A method according to claim 1 wherein said combustion-promoting metal is selected from platinum, palladium, iridium, osmium, rhodium, ruthenium, copper, chromium and manganese.

3. A method according to claim 1 wherein catalyst in said bed has an average carbon concentration of less than 0.1 weight percent.

4. A method according to claim 1 wherein said combustible fuel is a vaporizable hydrocarbonaceous fuel.

5. A method according to claim 1 wherein said combustible fuel is selected from at least one gaseous hydrocarbon, at least one vaporizable liquid hydrocarbon, or carbon monoxide.

* * * * *